United States Patent [19]

Mental

[11] Patent Number: 4,626,742

[45] Date of Patent: Dec. 2, 1986

[54] PLUG-COMPATIBLE ELECTROLUMINESCENT LAMP

[75] Inventor: Richard W. Mental, Indianapolis, Ind.

[73] Assignee: Microlite, Inc., Westfield, Ind.

[21] Appl. No.: 593,578

[22] Filed: Mar. 26, 1984

[51] Int. Cl.[4] ..... H05B 33/06; H05B 33/26

[52] U.S. Cl. ..... 313/503; 313/506; 313/511; 313/512

[58] Field of Search ..... 313/510, 512, 511, 506, 313/503, 51, 498; 427/66

[56] References Cited

U.S. PATENT DOCUMENTS

| | | | |
|---|---|---|---|
| 3,205,393 | 9/1965 | Mash | 313/509 |
| 3,315,111 | 4/1967 | Jaffe et al. | 313/503 |
| 3,580,738 | 5/1971 | Ranby | 427/66 |
| 4,138,620 | 2/1979 | Dickson | 313/512 X |
| 4,513,023 | 4/1985 | Wary | 313/503 X |

*Primary Examiner*—Palmer C. DeMeo

*Attorney, Agent, or Firm*—Barnes & Thornburg

[57] ABSTRACT

An electroluminescent device is disclosed having a layout particularly suited for plug compatibility. The device includes a polymeric substrate having a first conductor fixed to the substrate. The first conductor is spaced inwardly from the edges of the substrate in a preselected pattern to form a first electrode. A luminescent coating covers a first portion of the first electrode leaving at least one edge of the first electrode uncovered. The luminescent coating extends across a second edge of the first conductor and onto the substrate. A pair of second conductors are situated adjacent to each other on the substrate at a preselected distance. One of the pair of the second conductors covers substantially the whole of the luminescent coating and extends across the second edge onto the substrate. The other of the pair of second conductors extends along the one edge of the first conductor and on into the substrate. Preferably the pair of second conductors are simultaneously deposited in position by a second screen printing.

15 Claims, 4 Drawing Figures

PLUG-COMPATIBLE ELECTROLUMINESCENT LAMP

This invention relates in general to electroluminescent cells, lamps, and panels, which devices generate light in response to an applied electrical signal. The invention particularly relates to such devices having a pair of conductors which terminate in a manner which permits the attachment of pins or other plug compatible elements at a uniformly spaced dimension to permit connection to an electrical source. The invention also pertains to a unique method for constructing electroluminescent devices having inherent manufacturing simplicity and superiority.

Electroluminescent devices in the form of lamps or panels are themselves well known. A typical device comprises a finely divided phosphor dispersed in a binder and distributed in a thin layer between two plate or sheet electrodes, at least one of the electrodes being substantially transparent. The application of an electrical signal to the two electrodes causes the phosphor material to emit light, part of which is directed outwardly through the substantially transparent electrode.

The connection of the electrical signal to the electrodes requires that the electrodes have some termination elements which can be contacted by or affixed to appropriate electrical leads. Many methods of termination of such devices have been attempted with mixed results. Problems have been experienced in insuring that the leads to the electrodes do not exhibit undesirably high contact resistance or even capacitive coupling to the electrodes. Further problems have been experienced in uniformily spacing the leads so that connector elements attached thereto can also be uniformly spaced and compatible with conventionally manufactured plugs and the like.

An electroluminescent apparatus of the present invention includes a substrate with a first conductor or electrode fixed to substrate in a preselected pattern. A luminescent coating covers a first portion of the first conductor leaving a second portion of the first conductor uncovered. A pair of second conductors are simultaneously situated in spaced adjacent relationship on the substrate. One of the second conductors extends over the luminescent coating while the other of the second conductors contacts the uncovered portion of the first conductor. The pair of second conductors form leads leading from the luminescent area or body of the device to a terminal portion where pin elements are affixed in a manner compatible with standard dimensioned plugs. A water vapor impervious coating extends over the entirety of the device except for the end portion of the pair of second conductors so as to extend the life of the elements forming the device which tend to be water vapor sensitive.

The method used to form devices of the present invention utilizes a substrate which can be formed to include a body portion and a lead portion. The first conductor which forms one of the electrodes is deposited on the body portion of the substrate in a preselected pattern. The luminescent coating covers a first portion of the first electrode, the first portion typically comprising substantially the whole of the body portion of the device. A second portion, usually a peripheral portion, of the first conductor is left uncovered by the luminescent coating. A pair of second conductors are simultaneously deposited adjacent to each other. One of the pair of second conductors extends over the luminescent coating to form the second electrode while the other of the pair of second conductors contacts only the first portion of the first electrode. Both of the second conductors unitarily extend from the body portion linearly along the lead portion of the substrate to form a two-conductor lead of preselected length which terminates at the distal end of the lead portion of the substrate. All but the terminal portion of the pair of second conductors is covered by a protective coating so as to protect the electrical and light emitting functions of the device. A pair of pin elements or other similar contacts are then attached to the end of the pair of second conductors in a manner which assures uniform separation and thus plug compatibility of the device so formed.

One feature of the present invention is the simultaneous formation of the pair of second conductors which assures a uniform spacing of that pair of conductors to insure plug compatibility. An additional feature of the present invention is the presence of a water vapor impervious over coating extending over the entirety of the device but for the terminal portion of the pair of second conductors to protect the device from water vapor and other harmful environmental factors which tend to reduce the efficiency or otherwise render the performance of such devices unsatisfactory. As a result the life of the device so formed is considerably increased over similar devices in the prior art.

Another advantage of the present invention is that a number of devices can be simultaneously formed on a large single sheet of substrate which is thereafter diecut to form the individual luminescent devices. The pin elements or other contact devices can be attached using conventional contact stapling techniques with high reliability of both dimensional tolerance and electrical continuity.

Additional features and advantages of the invention will become apparent to those skilled in the art upon consideration of the following detailed description of a prefered embodiment exemplying the best mode of carrying out the invention as presently preceived. The detailed description particularly refers to the accompanying figures in which.

Figure 1:
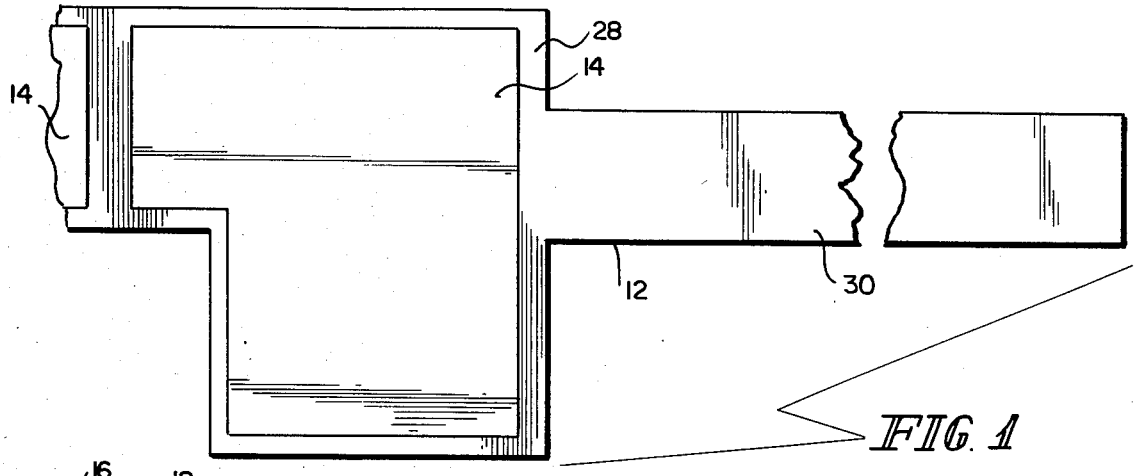
FIG. 1 is a plan view showing the substrate and first conductor deposited in a preselected pattern.
Figure 2:
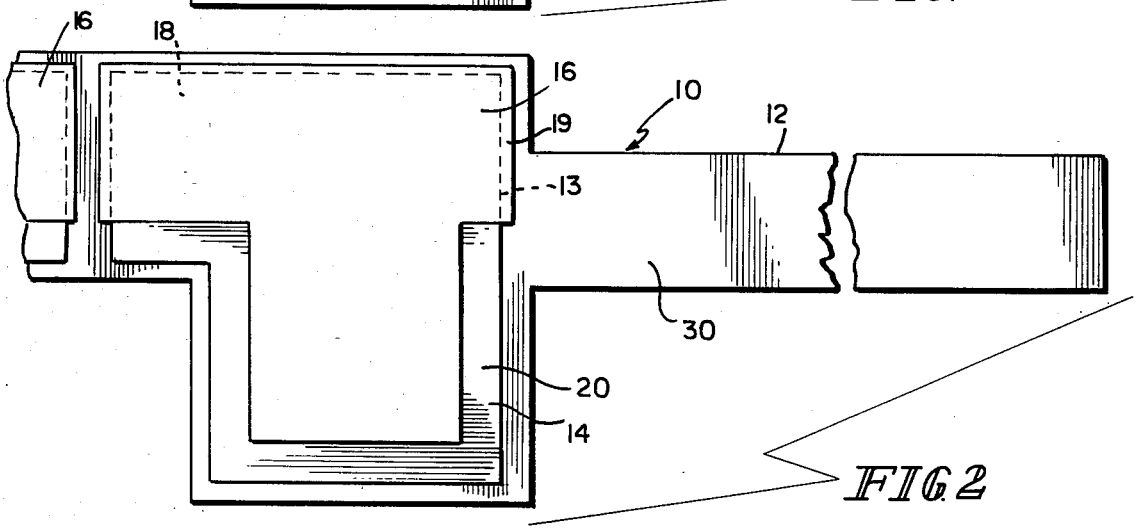
FIG. 2 is a plan view showing the positioning of the luminescent coating over the first conductor so as to leave at least one edge of the first conductor uncovered.
Figure 3:
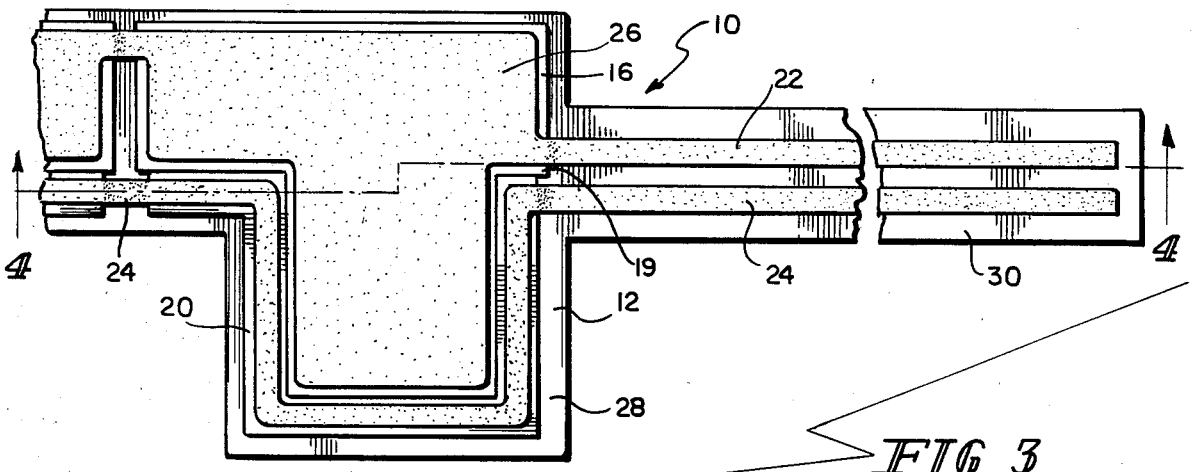
FIG. 3 is a plan view showing the deposition of the pair of second conductors adjacent to each other with one conductor contacting the luminescent coating and the other conductor contacting the first electrode.
Figure 4:
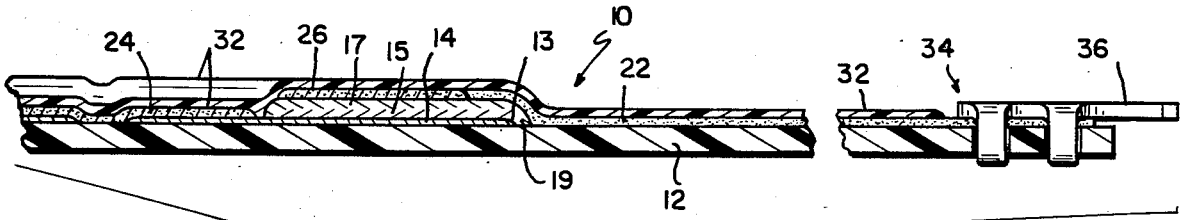
FIG. 4 is a sectional view taken along lines 4—4 of FIG. 3.

An electroluminescent device 10 in accordance with the present invention is illustrated in the various stages of its construction in FIGS. 1 through 3 and in final form in FIG. 4. The device 10 comprises a substrate 12 onto which is deposited a first conductor or electrode 14. A luminescent coating 16 covers a first substantial portion 18 of the first conductor 14 while leaving a second generally peripheral portion 20 of the first conductor 14 uncovered. One portion 19 of the luminescent coating 16 extends beyond an edge 13 of the first electrode 14.

A pair of second conductors 22 and 24 are deposited adjacent to each other. The second conductor 22 is deposited so as to contact portion 19 and substantially cover the luminescent coating 16 to form a second electrode 26 parallel to the first electrode formed by first conductor 14. The second conductor 24 is deposited so as to contact only the substrate 12 and the first conductor 14 in the second or pheripheral portion 20. The second conductor 24 thus forms an electrical lead for the first electrode 14.

The substrate 12 is shown to comprise a body portion 28 and a lead portion 30. The substrate is preferably formed of a flexible transparent sheet material composed of a polymeric resin which is sufficiently form stable to prevent any mechanical stretching which might destroy the continuity of the various coated layers placed on that substrate. An example of a satisfactory material is a polyester such as biaxially oriented polyethelene terephthalate (PET). The body portion 28 and lead portion 30 are unitary and in general are cut from a single sheet of 0.005 to 0.007 inch thickness subsequent to the deposition of the various layers disclosed herein.

The first conductor 14 comprises generally a substantially transparent metal oxide film which is spaced inwardly from the edge of substrate 12. Suitable metal oxide films can be formed of tin oxide, indium oxide, or nickle oxide with indium tin oxide being preferred. Metal oxide films having an optical transmittance of 60% or greater can be achieved while maintaining electrical continuity throughout the layer, the layer having a sheet resistance of less than about 2000 ohms per square. The metal oxide film is preferably formed by silk screening a solvent solution of a polyester resin containing the metal oxide on to the substrate 12. Alternatively, the metal oxide film may be formed in accordance with the general practices of U.S. Pat. No. 3,295,002.

The luminescent coating 16 is shown to cover substantially the whole of the first conductor 14 leaving only an edge portion 20 of the first conductor 14 exposed. The luminescent coating generally comprises a light emitting layer 15 and a light reflecting layer 17 as shown in FIG. 4. The light emitting layer 15 generally comprises a mixture of a phosphor and a binder. The phosphor may be an inorganic compound such as zinc sulfide or zinc oxide combined with suitable activators such as copper, manganese, lead or silver. Alternatively, the phosphor may be an organic luminescent agent such as anthracene, napthalene, butadiene, acridine or other similar material. The phosphor is mixed with a suitable binder which is selected to be compatible with the phosphor. Examples of suitable binders are polyvinyl chlorides, cellulose acetate, epoxy cements, and other similar materials. Particularly useful binders include cyanoethyl cellulose and ethyl hydroxyethyl cellulose.

The light reflective layer 17 is generally a mixture of a light reflective opacifier in a matrix which is itself a dieletric. The reflective opacifier is generally a metal oxide powder such as titanium oxide, lead oxide or barium titanate in a resin matrix of acrylic, epoxy, or other suitable resin.

The pair of second conductors 22 and 24 are deposited simultaneously so as to be positioned side by side on the lead portion 30 of the substrate 12. One of the second conductors 22 unitarily extends on top of the luminescent coating 16 so as to form the second electrode 26. The other second conductor 24 extends merely over the second portion 20 of the first conductor 14 which was left uncovered by the luminescent coating 16. The second conductor 24 is spaced from the luminescent coating by a distance sufficient to insure electrical isolation of the first electrode 14 and second conductor 24 from the second electrode 26. The second conductors 22 and 24 including the second electrode portion 26 of second conductor 22 are formed of a particulate metal in colloidal form which is deposited in combination with an evaporable medium leaving behind a conductive film of particulate metal. A suitable material is a silver conductive coating material commercially available from Atchison Colloids Company, Port Hureon, Michigan, under part name Electrodag 426SS. Other types of fluid silver conductive materials are commercially available which may perform satisfactory.

A final protective coating 32 is applied over the top of the various layers previously described to cover the entirety of the device except for a terminal end portion 34 shown in FIG. 4. The protective coating 32 comprises a water vapor impervious material which acts to prevent the migration of moisture into the circuit formed by the various layers 14, 16, 22 and 24. While curable silicone materials generally may be satisfactory to form this layer, a particularly advantageous material is the RTV polyester resins.

After the luminescent device has been so formed, a stamped metal connector 36 can be attached to the exposed terminal end portion of conductors 22 and 24 by stapling or other appropriate means. The spacing between the connector pins or elements 36 are set by the attaching equipment and by the spacing between the two second conductors 22 and 24 on lead portion 30. Since the two conductors 22 and 24 are simultaneously formed, the distance between the two conductors is uniformly maintained and hence the spacing of the pin connectors 36 can also be similarly maintained with very high reliability.

Although the invention has been described in detail with reference to certain preferred embodiments, variations and modifications exist within the scope and spirit of the invention as described and is defined in the following claims:

What is claimed is:

1. An electroluminescent apparatus comprising:

a substrate composed of a polymeric resin, a first conductor fixed to the substrate and spaced inwardly from the edges of the substrate in a preselected pattern to form a first electrode, a luminescent coating covering a first portion of the first conductor leaving at least one edge of the first conductor uncovered, the luminescent coating extending across a second edge of the first conductor onto the substrate; and a pair of second conductors situated adjacent to, but separated from, each other on the substrate, one of the pair of second conductors covering substantially the whole of the luminescent coating and extending across the second edge onto the substrate, the other of the pair of second conductors extending along the at least one edge of the first conductor and onto the substrate.

2. The apparatus of claim 1 wherein the substrate comprises a flexible transparent sheet having a body portion and a lead portion, said first conductor being confined to the body portion.

3. The apparatus of claim 2 wherein said pair of second conductor extends along said lead portion parallel to each other from said body portion to a terminal end remote therefrom.

4. The apparatus of claim 3 further comprising a water vapor impervious coating extending over the entirety of the luminescent coating and all but an end portion of the pair of second conductors, the end portion of said second conductors further comprising pin elements fixed at a predetermined spacing.

5. An electroluminescent device comprising a substrate having a surface bounded by a perimeter, a first conductor fixed to the substrate surface in a preselected pattern to form a first electrode, the first conductor having at least one edge spaced inwardly from the surface perimeter, a luminescent coating covering a first portion of the first conductor while leaving a second portion of the first conductor uncovered, the coating extending unitarily onto the substrate surface along at least one portion of said at least one edge, a pair of second conductors situated adjacent to but separated from each other on the substrate surface by a predetermined distance, one of the pair of second conductors extending unitarily on top of the luminescent coating within said at least one portion to substantially cover the luminescent coating to form a second electrode parallel to said first electrode, the other of the pair of second conductors extending unitarily on top of said second portion of the first conductor.

6. The apparatus of claim 5 wherein the substrate comprises a flexible transparent sheet composed of a polymeric resin.

7. The apparatus of claim 5 the first conductor comprises a transparent metal oxide film spaced inwardly from the edge of the substrate.

8. The apparatus of claim 5 wherein the luminescent coating covers substantially the whole of the first conductor leaving only one edge of the first conductor uncovered.

9. The apparatus of claim 8 wherein said other of the pair of second conductors extends along said only one edge of the first conductor.

10. The apparatus of claim 5 wherein the substrate comprises a body portion and a lead portion, said first conductor being confined to said body portion.

11. The apparatus of claim 13 wherein said pair of second conductors extend along said lead portion parallel to each other from said body portion to a terminal end remote therefrom.

12. The apparatus of claim 11 further comprising a pair of pin elements attached to said pair of second conductors at the terminal end of said lead portion remote from said body portion.

13. The apparatus of claim 5 further comprising a water vapor impervious coating extending over the entirety of the luminescent coating and all but an end portion of the pair of second conductors.

14. The apparatus of claim 5 wherein the luminescent coating comprises a light-emitting layer and an opaque, light-reflecting layer.

15. The apparatus of claim 14 wherein the opaque layer comprises a metal oxide powder in a matrix.

* * * * *

UNITED STATES PATENT AND TRADEMARK OFFICE

CERTIFICATE OF CORRECTION

PATENT NO. : 4,626,742

DATED : December 2, 1986

INVENTOR(S) : Mental

It is certified that error appears in the above-identified patent and that said Letters Patent is hereby corrected as shown below:

In Col. 4, line 66, delete "conductor" and insert --conductors--.

In Col. 6, line 14, delete "13" and insert --10--.

Signed and Sealed this

Eleventh Day of August, 1987

*Attest:*

*Attesting Officer*

DONALD J. QUIGG

*Commissioner of Patents and Trademarks*